United States Patent [19]

Wada et al.

[11] 4,269,920

[45] May 26, 1981

[54] DRY PROCESS DEVELOPING MATERIAL FOR ELECTROPHOTOGRAPHY

[75] Inventors: Kenichi Wada; Tateki Oka; Susumu Tanaka; Kenji Tabuchi, all of Sakai, Japan

[73] Assignee: Minolta Camera Kabushiki Kaisha, Japan

[21] Appl. No.: 940,133

[22] Filed: Sep. 6, 1978

[30] Foreign Application Priority Data

Sep. 16, 1977 [JP] Japan ..... 52-112081

[51] Int. Cl.[3] ..... G03G 9/14

[52] U.S. Cl. ..... 430/107; 430/111; 430/105

[58] Field of Search ..... 96/1 SD; 252/62.1 P; 430/109, 110

[56] References Cited

U.S. PATENT DOCUMENTS

| | | | |
|---|---|---|---|
| 3,909,258 | 9/1975 | Kotz | 96/1 R |
| 4,078,930 | 3/1978 | Mammino et al. | 96/1 SD |
| 4,111,823 | 9/1978 | Kobayashi et al. | 252/62.1 P |
| 4,142,981 | 3/1979 | Bean et al. | 252/62.1 P |

FOREIGN PATENT DOCUMENTS

| | | | |
|---|---|---|---|
| 52-4940 | 2/1977 | Japan | 430/107 |

*Primary Examiner*—Edward C. Kimlin
*Assistant Examiner*—John L. Goodrew
*Attorney, Agent, or Firm*—Wenderoth, Lind & Ponack

[57] ABSTRACT

A developing material for use in a dry developing electrophotography process which comprises an electrically insulating magnetizable toner including at least resin and magnetizable fine particles, and fine particles of resin different from the electrically insulating magnetizable toner in their position on the frictional electrical charging row. The electrically insulating magnetizable toner and fine particles of resin are mixed in a predetermined rate to form the developing material of the invention.

5 Claims, 3 Drawing Figures

DRY PROCESS DEVELOPING MATERIAL FOR ELECTROPHOTOGRAPHY

BACKGROUND OF THE INVENTION

The present invention relates to electrophotography and more particularly, to a developing material for use in a dry process method for developing electrostatic latent images, which developing material is also effective when employed in a method for developing a magnetizable toner which can be transferred onto plain copy paper through an electric field established by corona discharge.

Commonly, in the known dry process electrophotographic developing methods which have already been put into practical application, there is employed a developing material produced by mixing particles called carriers, for example, of iron particles or glass beads with non-magnetizable fine particles called toners, which developing material is mainly employed in the conventional two component developing methods, for example, the magnetic brush developing method, cascade developing method, etc.

The dry process two component developing methods as described above, however, have various problems particularly related to the carrier in that such carrier only serves in charging and transporting the non-magnetizable toner particles or as the developing electrode (in the case of the magnetic brush developing method) and is not directly engaged in the developing itself. Thus it is not consumed during each copying, and it gradually deteriorates with the increase in the number of copies made, generally making it necessary to be replaced after a predetermined number of copies has been made. Furthermore, particularly when the particle size of the carrier is too small or excess carrier is employed, the carrier may adhere onto the surface of the photosensitive member or photoreceptor in some cases, thus adversely affecting the quality of the copied images. Therefore, control of particle sizes and stabilization of the mixing ratio of carrier to toner are required, but such countermeasures are not desirable, since the size of the copying apparatus and developing device tend to be increased thereby.

Moreover, since the diameter of the carrier particle can not be made excessively small due to the above fact, an increase in the surface of such carrier particle is inevitably limited, and depending on the mixing ratio of the carrier to the non-magnetizable toner, there are cases where uneven charging for the non-magnetizable toner may take place.

In order to overcome the disadvantages inherent in the two component developing method as described above, it is conventional to employ a one component developing method employing magnetizable toner particles, and a direct type copying apparatus, i.e., copying apparatus which uses a photosensitive paper employing photosensitive material, without effecting transfer and which is based on the one component developing method. Meanwhile, although various attempts have also been made to apply the one component developing method to the copying apparatuses of transfer type, there are difficult problems to be solved related to physical properties in the developing and transfer in that conditions contrary to each other i.e., electrical conductivity during developing and electrical insulation during transfer are simultaneously required. More specifically, while the devoping is successful in the case of the electrically conductive, magnetizable toner particles having high electrical conductivity, there is a disadvantage such that during electric field transfer onto plain copy paper, the polarity of the magnetizable toner is varied due to injection of charge thereto from the copy paper, thus resulting in the so-called Blow-off phenomenon in which the toner once transferred onto the copy paper again leaves the same copy paper to cause non-uniform density and turbulence in the copied images.

For eliminating the undesirable non-uniform density and turbulence in the copied images as described above, there have conventionally been proposed various arrangements such as employment of electrically insulated copy paper (disclosed, for example, in Japanese Laid Open Patent Application Tokkaisho No. 50/90336, and Japanese Patent Publication Tokkosho No. 49/11576), pre-heating of copy paper (disclosed, for example, in Japanese Laid Open Patent Application Tokkaisho No. 50/43936), and uniform exposure of photosensitive surface to light before or during transfer (disclosed, for example, in Japanese Laid Open Patent Applications Tokkaisho No. 51/26044 and Tokkaisho No. 51/96332) etc., none of which is, however, related to improvement of the one component developing method.

On the contrary, the electrically insulating magnetizable toner particles have problems related to developing. More specifically, since such electrically insulating magnetizable toner particles are not sufficiently stable in charging, the developed images tend to be undesirably soiled, and for eliminating such disadvantages, auxiliary means, for example, means for subjecting the electrically insulating magnetizable toner to corona charging within the developing apparatus is required as disclosed in Japanese Laid Open Patent Application Tokkaisho No. 50/117432, thus resulting in complication in the structure of the developing apparatus.

Although a developing method employing a magnetizable toner having properaties intermediate the electrically conductive magnetizable toner and the electrically insulating magnetizable toner has also been conventionally proposed, for example, in Japanese Laid Open Patent Application Tokkaisho 50/92137, it is quite doubtful whether such magnetizable toner can satisfactorily provide the properties of the electrically conductive magnetizable toner and electrically insulating magnetizable toner, while problems arise in such magnetizable toner from the viewpoint of difficulty in manufacture thereof, stability under various temperatures and humidity conditions, etc.

SUMMARY OF THE INVENTION

Accordingly, an essential object of the present invention is to provide an improved dry process developing material for electrophotography which eliminates disadvantages inherent in the conventional dry process two component developing method and one component developing method, in order to achieve an efficient copying operation.

Another important object of the present invention is to provide an improved dry process developing material of the above described type which can readily be applied to conventional electrophotographic copying apparatus equipped with magnetic brush developing devices for obtaining clear and definite copied images without any fogging, turbulence, soiling, etc.

A further object of the present invention is to provide an improved dry process developing material of the above described type which is simple in structure and stable in functioning, and can be readily manufactured in a large quantity at low cost.

In accomplishing these and other objects, according to one preferred embodiment of the present invention, the developing material for use in dry process electrophotography comprises an electrically insulating magnetizable toner having a particle diameter, for example, of 5 to 25μ and including at least resin and magnetizable fine particles, and fine particles of resin having particle diameter, for example, of 0.1 to 30μ and different from said electrically insulating magnetizable toner in the position on the frictional electrical charging row, with the electrically insulating magnetizable toner being mixed into said fine particles of resin in an amount for example, of from 1 to 50 weight % with respect to the electrically insulating magnetizable toner to form said developing material.

By the constitution of the developing material of the present invention as described above, it has become possible not only to favorably develop the electrostatic latent images, but also to clearly transfer the developed unfixed toner images onto transfer material or copy paper, and thus inconveniences experienced in the known developing materials of similar type have been substantially eliminated.

It should be particularly noted here that the developing material according to the present invention is characterized in its construction in that:

(i) The magnetizable toner employed is of electrically insulating nature, and should preferably have a resistance higher than $10^{13}\Omega\cdot$cm and a particle size of approximately 5 to 25μ.

(ii) The fine particles of resin are added to the magnetizable toner, and should preferably have particle diameter of approximately 0.1 to 30μ, with the mixing ratio thereof to said magnetizable toner being approximately 1 to 50% by weight.

(iii) The resin constituting said fine particles is different, in the position thereof on the electrically frictional charging row, from said magnetizable toner. More specifically, upon frictional contact of said fine particles with the magnetizable toner, said magnetizable toner is electrically charged. Said resin for the fine particles should preferably be substantially colorless and transparent, non-magnetizable and capable of being fixed.

Meanwhile, it should also be noted that the present invention is particularly characterized in the following points:

(a) Since the fine particles of resin are mixed into the magnetizable toner, the magnetizable toner is readily charged under a stable state through frictional charging between said magnetizable toner and fine particles of resin.

(b) Large surface areas of said fine particles of resin are effective for sufficient charging of the magnetizable toner, with the charging being effected still more stably. Moreover, even in cases where the fine particles adhering to the image formed portion are not transferred onto copy paper during transfer, defects such as white portions and the like in the copied images do not readily take place.

(c) Upon comparison with the conventional two component developing materials, the developing material according to the present invention has advantages as follows, since the magnetizable toner which is the main component of the developing material is used for the developing together with the fine particles of resin.

(i) Stable development is effected at all times without deterioration and the like of the developing material, and thus maintenance work such as replacement of deteriorated developing material, etc. is not necessary.

(ii) Since the magnetizable toner and fine particles of resin are each consumed at a constant rate under predetermined conditions, the mixing ratio for each of the components can be continuously maintained at a predetermined level only through replenishment of the developing material suited to such rate of consumption, and thus not only a separate means such as means for detecting the mixing ratio of said two components is not required, but stable development is possible in cooperation with the effect described with reference to the above item c-(i).

(d) Upon comparison with the conventional one component developing materials, the developing material according to the present invention, in which the magnetizable toner employed is of electrically insulating nature, is capable of positively transferring the toner image through employment of known corona discharging means, thus being readily applicable to transfer type copying apparatuses, without necessity for separately providing any particular structure.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
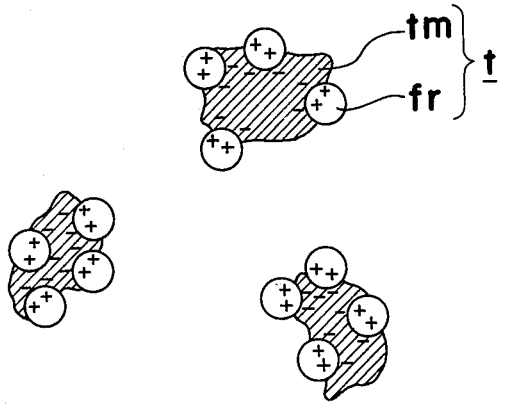
FIG. 1 is a schematic diagram illustrating the structure of the developing material employable for dry process developing according to the present invention.

In the present invention, for stabilization of charging of the electrically insulating magnetizable toner to eliminate the disadvantages as described in the foregoing, the electrically insulating magnetizable toner is triboelecrically or frictionally charged by mixing thereof with fine particles of resin having a position different from that of the electrically insulating magnetizable toner on the frictional electrical charging row. More specifically, in the present invention, by employing the electrically insulating magnetizable toner, the fine particles of resin are positionally different from said electrically insulating magnetizable toner on the frictional charging row. Thus, by use of a suitable developing device as described below, it has been made possible not only to favorably develop electrostatic latent images into visible toner images, but to transfer the unfixed toner images thus obtained by the development onto transfer material or copy paper in an efficient manner. For the developing device, there may be employed the known arrangements employing the magnet roll in which a magnet member is rotated within an outer cylinder or sleeve, or the sleeve is rotated with the magnet held stationary in the sleeve, and other arrangements generally known as the magnetic brush developing devices. Meanwhile, the electrically insulating magnetizable toner to be employed in the present invention is mainly composed of resin, coloring agent and fine particles of highly magnetizable material, with insulating property being given thereto by the resin. The fine particles of resin employed in the present invention are intended to impart the tribo-electrical charge to the electrically insulating magnetizable toner for eliminating inconveniences due to uneven charging taking place when such electrically insulating magnetizable toner is to be frictionally charged by the developing sleeve as disclosed, for example, in Japanese Laid Open Patent Application Tokkaisho No. 50/45639 in which sufficient charging of the electrically insulating magnetizable toner is difficult to achieve due to the small surface area of the electrically insulating magnetizable toner particles which contribute to the tribo-electrical charging with respect to the surface of the developing sleeve.

According to the present invention, the electrically insulating magnetizable toner has a sufficiently large surface area by the inclusion of the fine particles of resin for ample charging of said electrically insulating magnetizable toner. Moreover, since the fine particles of resin are generally of insulating nature and tend to increase the degree of insulation of said electrically insulating magnetizable toner, there is no significant change in the effect, even if the electrically insulating magnetizable toner has electrical conductivity to a certain extent. Meanwhile, the electrically insulating magnetizable toner is arranged to have a polarity opposite to that of the charge of the electrostatic latent images formed on the photosensitive member or photoreceptor by considering the position of the fine particles of resin on the frictional charging row, and thus said fine particles of resin are naturally charged to the same polarity as that of the electrostatic latent images. During the development with the use of the developing material as described in the foregoing, the electrically insulating magnetizable toner, which has overcome the magnetic force thereof and the attracting force of the magnet roll through coulomb force produced by the charge of the electrostatic latent images on the photoreceptor and the charging of the toner, adheres onto the photoreceptor. On the other hand, concerning the fine particles of resin, various results are obtained depending on the material, particle diameter, surface properties and the like, and such fine particles having the charge of the same polarity as that of the latent images on the photoreceptor are subjected to a repulsion due to the coulombic force, and simultaneously are attracted by coulombic force because of their charge opposite in polarity to the toner. Therefore, depending on the balance between the factors described above, there may be cases where the fine particles adhere to the latent images on the photoreceptor, or where they do not adhere to the latent image, but rather to edge portions outside of the latent images due to electric field established by said latent images, or where they do not adhere to the photoreceptor at all. Meanwhile, in the transfer process as well, the resultant images produced by the developing material of electrically insulating nature and having electrical charge imparted thereto as described above are completely free from blotting or blur noticed in the conventional one component developing methods. In a similar manner as in the above development, there are cases where the fine particles of resin adhere to the electrically insulating magnetizable toner so as to be transferred or where they are not transferred at all, but such fine particles are generally transferred onto copy paper to a certain extent due to phenomenon known as fogging. Even in such a case, if said fine particles are made substantially colorless and transparent depending on necessity, no significant deterioration in the quality of the copied images is noticed, even if they adhere to the copy paper, but on the contrary, there is an advantage such that the heat fixing is facilitated by forming the fine particles, for example, with thermoplastic resin having low melting point. In other words, insufficient fixing noticed due to a low proportion of resin in the toner when only the magnetizable toner is employed as the developing material is supplemented by the fine particles of the resinous material for sufficient heat fixing. Moreover, by preparing the fine particles as described above with wax, soft resin and the like, it becomes possible to effect pressure fixing.

As is seen from the foregoing description, according to the present invention, by charging the electrically insulating magnetizable toner with the fine particles of resin, sufficiently clear and definite copied images are obtainable, while the fixing is much facilitated by the employment of said fine particles of resin.

Furthermore, by making said fine particles substantially colorless and transparent, inconveniences such as occurrence of fogging in the copied images, etc. can advantageously be eliminated, thus copied images of still higher quality being obtainable.

It should be noted here that the term "substantially colorless and transparent" used in the present invention means transparency to such an extent that the copied images are not adversely affected even when the fine particles are transferred and fixed onto the copy paper, and although the substantially colorless and transparent fine particles may appear whitish due to scattering of light rays in the state of powder, they show enough transparency so as not to have any influence on the copied images after the fixing.

It should also be noted that when the fine particles of resin are not to adhere to the latent image formed portion on the photoreceptor, but to the non-latent image formed portion, such fine particles may have a color which will be equal to the tone of shade of the copy paper when fixed to the latter. For example, when the copying is made onto yellow copy paper, with the fine particles colored yellow, such fine particles do not appear as fogged images, even if they adhere to the non-image formed portions in the form of the fogging.

Referring now to the drawings, there is shown in FIG. 1 a schematic diagram illustrating one preferred embodiment of the structure of developing material t employable for a dry process developing according to the present invention. In FIG. 1, the developing material t generally includes electrically insulating magnetizable toner particles tm each composed at least of resin and magnetizable fine particles (not shown), and mixed with fine particles fr for resin which are different from said electrically insulating toner particles tm in the position on the frictional charging row so that the toner particles tm are charged, for example, to negative polarity and the fine particles fr of resin to positive polarity as shown. The particle diameter of the electrically insulating toner particles tm should preferably be in the range from 5 to 25μ, while that of the fine particles fr of resin in the range of 0.1 to 30μ. The fine particles fr of resin should preferably be mixed in 1 to 50 weight % with respect to the electrically insulating magnetizable toner tm.

Figure 2:
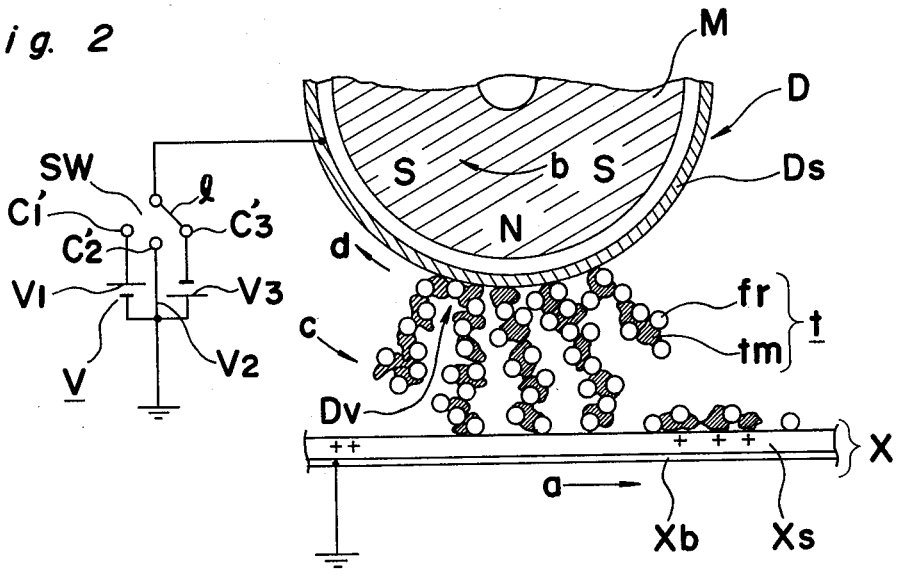
FIG. 2 is a fragmentary schematic diagram explanatory of a fundamental arrangement of a magnetic brush type developing apparatus to which the developing material of the present invention may be applied.
Figure 3:
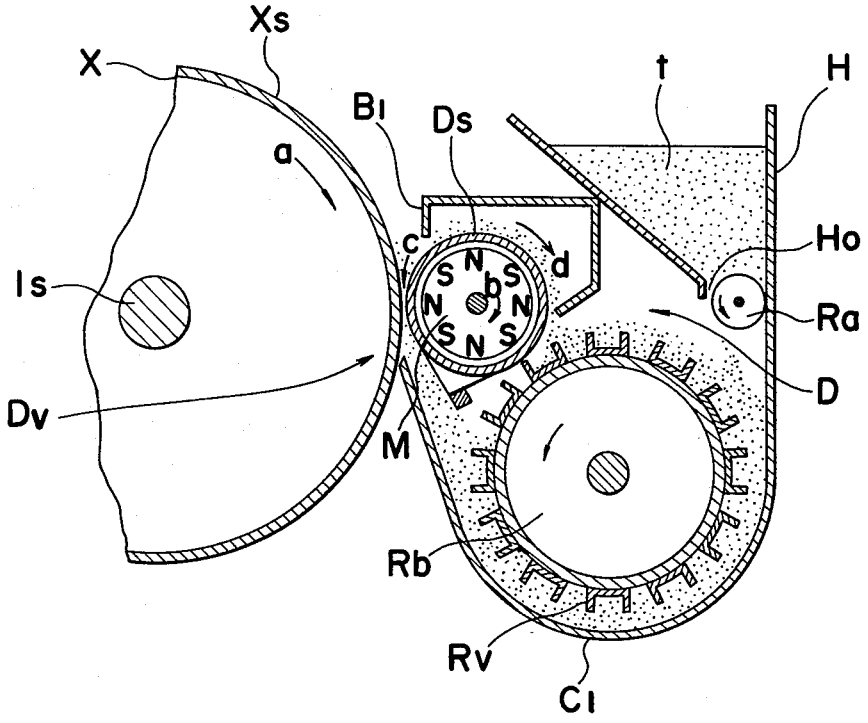
FIG. 3 is a schematic side sectional view of a magnetic brush type developing apparatus in which the arrangement of FIG. 2 is incorporated.

Referring particularly to FIGS. 2 and 3, the process in which an electrical potential pattern or electrostatic latent image formed on a recording medium, i.e., a photosensitive member or photoreceptor X is developed into a visible image by the developing material t according to the present invention will be described hereinbelow.

In FIGS. 2 and 3, there is schematically shown a known magnetic brush developing device D to which the dry process developing material t according to the present invention may be applied. The developing device D generally includes the outer cylinder or sleeve Ds of electrically conductive non-magnetizable material enclosed in a housing $C_1$ and rotatably disposed for rotation in the direction of the arrow d (at low speed) adjacent to the photoreceptor X which may be in the shape of a drum and composed of a photosensitive layer or surface Xs formed on an electrically conductive base Xb and which is movable or rotatable in the direction of the arrow a about a shaft ls by suitable driving means (not shown), a magnet roller M having a plurality of magnetic poles and rotatably accommodated in said sleeve Ds for rotation in the direction of the arrow b, a developing material stirring roller Rb having a plurality of blade-like members Rv radially outwardly extending from the outer periphery thereof and rotatably provided under the developing sleeve Ds in the housing $C_1$ for stabilization of the frictional charging between the particles tm and particles fr, a toner supplying tank or hopper H accommodating therein the developing material t and provided above and adjacent to the stirring roller Rb for supplying the developing material t onto the roller Rb through an opening $H_0$ formed at the bottom portion of said hopper H and having a developing material supplying roller Ra rotatably provided therein and a magnetic brush height restricting plate $B_1$ extending downwardly from one wall of the hopper $H_1$ toward the surface of the sleeve Ds for restricting the height of the brush bristles formed on the sleeve Ds and transported in the direction of the arrow c as the magnet roller M rotates within the sleeve Ds.

On the photosensitive layer Xs of the photoreceptor X, an image of an original to be copied (not shown) is preliminarily formed in the known manner in the form of the electrostatic latent image, for example, of positive polarity for movement toward the right in FIG. 2 as the photoreceptor X is moved in the direction of the arrow a. Meanwhile, the magnet roller M and outer sleeve Ds are driven by suitable means (not shown) for rotation in the direction of the arrows b and d respectively, and developing material t including the particles tm and particles fr and supplied through the opening $H_0$ of the hopper H is transported in the direction of the arrow c over the sleeve Ds to a developing position Dv whereat the sleeve Ds confronts the surface of the photosensitive layer Xs. At the developing position Dv, the particles tm containing the magnetizable fine particles form the so-called magnetic brush bristles along the magnetic lines of force due to the magnetic poles of the magnet roller M, with tips of such brush bristles contacting the surface of the photosensitive layer Xs of the photoreceptor X for developing the electrostatic latent image formed on said photosensitive layer Xs.

It should be noted here that in the arrangement of FIGS. 2 and 3, the outer sleeve Ds is coupled to a developing bias impressing voltage source V through a changeover switch SW which can selectively connect the outer sleeve Ds to positive potential $V_1$, ground potential $V_2$ and negative potential $V_3$ through changing over of a contactor l to stationary contacts $C_1'$, $C_2'$ and $C_3'$ so as to control the bias potential for regulating the rate of adhesion of the fine particles fr of resin to the photoreceptor X, although it is needless to say that such rate of adhesion is varied by the amount of charging, particle diameter, state of the surfaces, configurations, etc. of the magnetizable toner tm and fine particles fr of resin.

Hereinbelow, results of experiments carried out with the use of the dry process developing material t according to the present invention and the developing device D as described in the foregoing will be given for illustrating the present invention, without any intention of limiting the scope thereof.

In the Examples described hereinbelow, the toner employed therefor was prepared in the following manner:

For electrically insulating magnetizable toner particles:

HYMER-SBM-73: 50 parts by weight;
(styrene-acrylic resin: name used in trade and manufactured by Sanyo Chemical Industries, Ltd. Japan)

Magnetizable iron oxide RB-BL: 50 parts by weight;
(name used in trade and manufactured by Chitan Kogyo Co., Ltd. Japan)

KETJEN BLACK EC: 2 parts by weight;
(name used in trade and manufactured by the Lion Fat and Oil Co., Ltd. Japan).

The above materials, after having been mixed, were subjected to heating and kneading with the use of a three-roll mill, and, subsequent to cooling, crushed by a grinder into toner particles having particle diameter of 15 to 25μ and resistivity of $10^{14}$ Ω·cm.

EXAMPLE 1

Substantially colorless and transparent fine particles of polyamide (5μ in average diameter) were mixed with the electrically insulating magnetizable toner particles prepared in the above described manner for developing electrostatic latent images of positive polarity formed on the photoreceptor, and the developed images were then transferred onto copy paper for subsequent fixing thereto. As a result, clear and definite copied images were obtained.

In the fixing, less heat was required for heat fixing to achieve optimum results than in the comparative experiment mentioned later wherein only the earlier stated electrically insulating magnetizable toner particles were employed, while the fixing was favorable even in the pressure fixing.

EXAMPLE 2

Fine particles of Teflon (Trade name) having average diameter of 0.6μ were mixed with the electrically insulating magnetizable toner particles described earlier, and the mixture was used for developing latent images of negative polarity formed on the photoreceptor, with the developed images thus obtained being further transferred and fixed onto plain copy paper. As a result, clear and definite copied images were obtained. In the above Example 2, although the fine particles of Teflon were not sufficiently transparent, with slightly whitish appearance, no adverse effect was noticed on the resultant copied images. Furthermore, upon observation of the state of adhesion onto the photoreceptor after the developing, the fine particles of Teflon hardly adhered to the image formed portions, while said fine particles adhering to the non-image formed portions were not transferred in the transfer process.

EXAMPLE 3

With the use of the developing material having the same compositions as described with reference to Example 1, latent images of negative charge were developed, and the developed images were then transferred onto copy paper for subsequent fixing thereto. As a result, copied images on the copy paper generally suitable for practical purposes were obtained, although the quality of the copied images was slightly lower than that in Example 1.

Comparative Experiment

When the copying was effected with the use only of the electrically insulating magnetizable toner described earlier without mixing of the fine particles of resin, the developing was limited only to edge portions of the images, thus not being fit for actual use, which state is considered to have resulted from the fact that, since the triboelectrical charging of the electrically insulating magnetizable toner is achieved only through contact of said toner with the sleeve or stirring member of the developing device, the amount of charging of the toner is small, causing such toner to adhere only to the edge portions of the images whereat strong a electric field is present. In the transfer also, much greater heat was required than in Example 1, and the fixing was hardly effected through the pressure fixing.

In the foregoing Examples, since the fine particles of resin are added to charge the electrically isulating magnetizable toner particles, such fine particles may be different, in their position on the frictional charging row, from said magnetizable toner particles, and for sufficiently charging the electrically insulating magnetizable toner particles, they should preferably have a particle diameter approximately in the range from 0.1 to 30μ. A mixing ratio thereof with the electrically magnetizable toner particles approximately in the region from 1 to 50 wt % gives favorable results, although such results may differ depending on the particle diameter, material and configuration, etc. of said fine particles.

More specifically, the fine particles of resin described above may be formed of polyester resin, methacrylic resin, polyethylene, polyamide, polycarbonate, polystyrene, epoxy resin, styrene, acrylic resin and mixtures thereof, wax, paraffin, etc. Such resin particles may be mixed with the electrically insulating magnetizable toner particles, with fixing properties of such materials taken into consideration. Moreover, an electrical charging control agent may further be added to the fine particles of resin for controlling charging for the electrically insulating magnetizable toner and the fine particles of resin.

Additionally, it is to be noted that, although the fine particles of resin should preferably be substantially colorless and transparent, such fine particles need not necessarily be colorless and transparent in cases where they do not adhere to the non-image formed portions ultimately, but, on the contrary, should preferably be of a shade approximately equal to that of the electrically insulating magnetizable toner.

For example, when the materials for the magnetizable toner and fine particles of resin are properly selected for the fine particles to be stably charged, with a small charging amount of the magnetizable toner, adhesion of the fine particles of resin to the non-image formed portion hardly takes place. In the case as described above, there is no adverse effect to the formed image, and rather, it is preferable that the fine particles of resin have approximately the same shade as the magnetizable toner.

Hereinbelow, results of further experiments carried out with the use of the dry process developing material of the invention which employs toner prepared in the following manner will be described.

For electrically insulating magnetizable toner particles:

HYMER-SBM-73: 50 parts by weight;
(Styrene-acrylic resin: name used in trade and manufactured by Sanyo Chemical Industries, Ltd. Japan)

Magnetizable iron oxide RB-BL: 100 parts by weight;
(name used in trade and manufactured by Chitan Kogyo Co., Ltd. Japan)

KETJEN BLACK EC: 2 parts by weight;
(name used in trade and manufactured by the Lion Fat and Oil Co., Ltd. Japan).

The above materials, after having been mixed, were subjected to heating and kneading with the use of a heating kneader, and subsequent to cooling, crushed by a grinder into toner particles having particle diameter of 10 to 30μ and resistivity of $10^{13}$ to $10^{14}$ Ω·cm. Such toner as described above will be referred to as toner B in the following Examples.

EXAMPLE 4

For the fine particles of resin:

HYMER SBM-73: 100 parts by weight;
KETJEN BLACK EC: 8 parts by weight;
Nigrosine: 1 part by weight;
(Manufactured by Orient Chemical Co., Ltd. Japan).

The above materials, after having been mixed, were subjected to heating and kneading with the use of the heating kneader, and subsequent to cooling, crushed by a grinder into fine particles of resin having particle diameter of 4 to 20μ and the same black tone of shade as the toner B. The charging amount by the combination of said fine particles of resin and toner B is small at 10 μc/g, due to the fact that said fine particles are mainly prepared by the same resin as that of the toner B.

The fine particles of resin obtained in the manner as described above were mixed with the magnetizable toner B mentioned earlier for developing the photoreceptor having an electrostatic latent image of positive charge formed thereon, and the visible toner image thus obtained was transferred onto plain copy paper, and subsequently fixed by a heated roller. As a result, copied image of good quality was obtained. Additionally, upon examination of the state of the developing material adhering to the photoreceptor after the development, it was noticed that the magnetizable toner and a slight amount of the fine particles of resin adhered only to the image formed portion, thus indicating that the developing material of the invention is also applicable to copying apparatuses of direct type.

It is to be noted here that the fine particles of resin adhering to the non-image formed portion can not be transferred from the photoreceptor to a transfer material or copy paper by the image transfer method through corona discharge in the ordinary transfer type electrophotographic copying apparatus. Therefore, in the copying apparatuses of the above described type, the fine particles of resin may be colored in the similar manner as stated earlier.

EXAMPLE 5

In Example 5, toner for Minolta EP-1 (manufactured by Minolta Camera Kabushiki Kaisha, Japan) was used as the fine particles of resin with respect to the toner B, with the charging amount of the toner B being 18 $\mu$c/g.

The magnetizable toner and the toner for Minolta EP-1 were mixed for developing the photoreceptor having the electrostatic latent image of positive charge formed thereon, and the visible toner image thus obtained was transferred onto plain copy paper, and subsequently fixed by a heat roll. As a result, a copied image of good quality was obtained. Upon examination of the state of the developing material adhering to the photoreceptor after the development, it was noticed that the magnetizable toner and toner for EP-1 adhered to the image formed portion, while only the toner for EP-1 adhered to the portion around the image formed portion, but such toner for EP-1 was not transferred.

It should be noted here that the fine particles of resin referred to in the present invention includes those composed of a mixture of a plurality of compositions, and that in the above case, the position of the mixture on the frictional charging row with respect to the magnetizable toner should be compared on the assumption that such mixture is a substance.

It should also be noted that, for the electrically insulating magnetizable toner particles, those having known structure may be employed, with particle diameter thereof being preferably of 5 to 25$\mu$ for optimum results.

As is clear from the foregoing description, according to the developing material of the present invention, the electrostatic latent images can be favorably developed, while it has been made possible to clearly and definitely transfer the unfixed toner images obtained by the corona transfer onto the copy paper through the corona transfer, with substantial elimination of disadvantages inherent in the conventional developing materials of the kind. In other words, the developing material according to the present invention can be readily applied to copying apparatuses of both direct type and transfer type.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A developing material for dry developing an electrostatic latent image which material comprises (a) electrically insulating magnetizable toner particles in the range from 5 to 25 $\mu$-microns having a resistance higher than $10^{13}$ $\Omega$·cm and comprising resin and magnetizable fine particles, and (b) fine particles of substantially colorless and transparent resin in the range of 0.1 to 30 microns, wherein said fine particles of resin are admixed with said electrically insulating magnetizable toner in an amount of from 1 to 50 weight % with respect to said electrically insulating magnetizable toner;

said fine particles of resin being different from said electrically insulating magnetizable toner in their position on a frictional electrical charging row whereby said electrically insulating magnetizable toner and fine particles of resin are triboelectrically charged respectively to opposite polarities to each other through frictional contact therebetween, and said toner, as a result of said frictional contact with said fine particles, having a polarity opposite that of said electrostatic latent image;

said electrically insulating magnetizable toner and said fine particles being mixed to form said developing material.

2. The developing material as claimed in claim 1, wherein said fine particles of resin are of non-magnetizable nature.

3. The developing material as claimed in claim 1, wherein said fine particles of resin are capable of being fixed.

4. The developing material as claimed in claim 1, wherein said developing material is used for a magnetic brush developing device.

5. The developing material as claimed in claim 1, wherein said fine particles of resin are of electrically insulating nature.

* * * * *